US008925838B2

(12) United States Patent
Drechsel

(10) Patent No.: US 8,925,838 B2
(45) Date of Patent: Jan. 6, 2015

(54) LIQUID DIFFUSING DEVICE WITH INTERCHANGEABLE NOZZLES

(76) Inventor: Arno Drechsel, Lienz (AT)

( * ) Notice: Subject to any disclaimer, the term of this patent is extended or adjusted under 35 U.S.C. 154(b) by 353 days.

(21) Appl. No.: 13/054,079

(22) PCT Filed: Jul. 24, 2009

(86) PCT No.: PCT/IB2009/053221

§ 371 (c)(1),
(2), (4) Date: Jan. 14, 2011

(87) PCT Pub. No.: WO2010/010533

PCT Pub. Date: Jan. 28, 2010

(65) Prior Publication Data

US 2011/0155827 A1 Jun. 30, 2011

(30) Foreign Application Priority Data

Jul. 24, 2008 (IT) ..... VI2008A0176

(51) Int. Cl.

| | |
|---|---|
| ***B05B 1/00*** | (2006.01) |
| ***B05B 3/02*** | (2006.01) |
| ***F23D 11/04*** | (2006.01) |
| ***A62C 31/02*** | (2006.01) |
| ***A62C 15/00*** | (2006.01) |
| ***B05B 1/16*** | (2006.01) |
| ***B05B 3/00*** | (2006.01) |
| ***B05B 3/04*** | (2006.01) |
| *B05B 15/06* | (2006.01) |
| *B05B 1/26* | (2006.01) |

(52) U.S. Cl.

CPC . *B05B 1/16* (2013.01); *B05B 15/06* (2013.01); *B05B 1/265* (2013.01); *B05B 3/008* (2013.01); *B05B 3/0486* (2013.01); *B05B 15/065* (2013.01)

USPC ..... 239/600; 239/214; 239/392; 239/442

(58) Field of Classification Search

CPC ..... B05B 15/06; B05B 15/065
USPC ..... 239/222, 214, 600, 391, 397, 392, 442
See application file for complete search history.

(56) References Cited

U.S. PATENT DOCUMENTS

| | | | | | |
|---|---|---|---|---|---|
| 1,798,709 | A | * | 3/1931 | Smith | 239/442 |
| 5,158,231 | A | | 10/1992 | Christen | |
| 5,253,807 | A | * | 10/1993 | Newbegin | 239/11 |
| 5,439,174 | A | * | 8/1995 | Sweet | 239/222.17 |
| 5,588,595 | A | * | 12/1996 | Sweet et al. | 239/222.17 |

(Continued)

FOREIGN PATENT DOCUMENTS

| | | |
|---|---|---|
| EP | 1738833 | 1/2007 |

*Primary Examiner* — Len Tran
*Assistant Examiner* — Alexander Valvis
(74) *Attorney, Agent, or Firm* — Themis Law

(57) ABSTRACT

A liquid diffusing device with interchangeable nozzles includes a support frame having a passageway for the liquid to be diffused, with an inlet and an outlet, at least one nozzle having a liquid outlet section with a predetermined diameter and a corresponding outflow rate, which is removably and selectively attachable to the outlet in a predetermined operating position, and a system for supporting at least one additional nozzle having an outlet section of a diameter other than that of the first nozzle in the non-operating position. The support system comprises a nozzle-holding plate formed of one piece with the frame and having quick a connect/disconnect system for the additional nozzle in the non-operating position.

6 Claims, 5 Drawing Sheets

(56) References Cited

U.S. PATENT DOCUMENTS

| | | | | |
|---|---|---|---|---|
| 5,762,269 | A * | 6/1998 | Sweet | 239/71 |
| 6,085,995 | A | 7/2000 | Kah | |
| 6,182,909 | B1 * | 2/2001 | Kah et al. | 239/206 |
| 6,234,411 | B1 * | 5/2001 | Walker et al. | 239/289 |
| 6,651,909 | B1 * | 11/2003 | Bugarin | 239/390 |
| 6,811,098 | B2 * | 11/2004 | Drechsel | 239/498 |
| 6,854,663 | B2 * | 2/2005 | Bugarin | 239/114 |
| 6,988,677 | B2 * | 1/2006 | Sodemann et al. | 239/525 |
| 7,472,840 | B2 * | 1/2009 | Gregory | 239/289 |
| 2002/0134860 | A1 | 9/2002 | Halle | |

* cited by examiner

LIQUID DIFFUSING DEVICE WITH INTERCHANGEABLE NOZZLES

FIELD OF THE INVENTION

The present invention generally finds application in the field of irrigation systems for agricultural and industrial applications, and particularly relates to a liquid diffusing device with interchangeable nozzles, of the type generally suitable for use in an irrigation system.

BACKGROUND ART

Rotating liquid diffuser devices as used in irrigation systems for delivery of water, commonly known as "sprinklers", comprise a support frame which is designed to be connected to the hydraulic system and has a nozzle for directing the liquid jet to a diffusion plate.

The latter is conveniently formed with a plurality of radial grooves for peripheral jet delivery.

The plate may be fixed or move, under the thrust exerted by the jet, with a combined rotational and precessional motion about a central axis, for peripheral jet diffusion.

The area that can be reached by the deflected jet may vary according to the jet length and the plate shape.

Various diffuser solutions are known in the art, either with a rotary or fixed plate, or with a lance, which are designed to receive nozzles of various outlet diameters and allow adjustment of jet length for irrigation of areas of various sizes.

Some of these prior art solutions, as disclosed for instance in EP1738833 and U.S. Pat. No. 6,085,995, have a diffuser member with a plurality of fixed nozzles having different outlet sections, that can be selectively chosen by the rotation of a disk element.

Nevertheless, these prior art solutions require a complex fabrication process and also limit the types of usable nozzles to those available in the diffuser member.

U.S. Pat. No. 6,651,909 discloses a lance-type diffuser having a nozzle-holding plate designed for removable connection to the diffuser body and having a plurality of circular seats for respective nozzles to be snap fitted therein.

A first drawback of such solution is that the nozzle-holding plate is external to the diffuser, which increases assembly complexity and overall diffuser costs, and involves the risk of losing the plate.

Furthermore, this particular type of fit may lose its efficiency with time, upon repeated fitting of the nozzles into and out of their seats, which may thus be deformed or broken.

U.S. Pat. No. 5,762,269 discloses a rotating diffuser device with a frame that supports a liquid jet delivery nozzle at one end and a jet deflecting member at the other end.

The diffuser further has a plate composed of two rings, which is designed to be removably attached to the support frame at the jet delivery section.

One of the two rings will receive the nozzle in its operating position, and the other will be designed to support a replacement nozzle.

Whenever the operating-position nozzle needs to be replaced with the other nozzle, this will require dismantling of the upper portion of the frame, removal of the ring plate and 180° rotation thereof to move the replacement nozzle into the operating position.

It will be understood that this prior art solution suffers from the drawbacks of inconvenient use and long nozzle removal and replacement times.

Furthermore, the nozzle-holding plate is still external to the diffuser and susceptible of being lost.

Also, none of the prior art devices allows the user to simply and promptly identify the available nozzles.

DISCLOSURE OF THE INVENTION

The object of the present invention is to overcome the above drawbacks, by providing a diffuser device with interchangeable nozzles that has a relatively simple cost-effective construction.

A particular object of the present invention is to provide a diffuser device with interchangeable nozzles, that allows quick and simple nozzle replacement, without using any external equipment.

Another object of the present invention is to provide a diffuser device that can eliminate the risk of losing the replacement nozzles.

A further object of the present invention is to provide a diffuser device with interchangeable nozzles, that allows the user to simply and promptly identify both the replacement nozzles and the operating-position nozzle.

Another important object is to provide a diffuser device with interchangeable nozzles that ensures proper coupling of the replacement nozzles and the holding plate, even after repeated extractions and insertions.

These and other objects, as better explained hereafter, are fulfilled by a liquid diffusing device with interchangeable nozzles, which comprises a support frame having a passageway for the liquid to be diffused, with an inlet and an outlet, said inlet being designed to be coupled to a liquid feeding pipe, at least two nozzles, removably and selectively attachable to said outlet in a predetermined operating position, said at least two nozzles having liquid outlet sections with different diameters for directing liquid jets with respective outflow rates.

The device is characterized in that it comprises a nozzle-holding plate formed of one piece with the frame and having quick nozzle connect/disconnect means for holding at least one of said nozzles against the frame in a non-operating position.

Due to this configuration, the device will be of simple construction and use and will allow the replacement nozzles, with their respective support plate, to be always mounted to the support frame.

Advantageously, the quick connect/disconnect means may include a plurality of counter-shaped holding seats mating with the nozzles, and defining respective non-operating positions, for removably accommodating the nozzles.

Furthermore, the holding seats may be substantially similar and be formed at the periphery of the plate with respective curved lateral peripheral openings to facilitate sliding insertion of any nozzle therein.

With this particular configuration, the device will ensure stable coupling of the plate and replacement nozzles even after many repeated extractions and insertions of said replacement nozzles from and into the plate.

BRIEF DESCRIPTION OF THE DRAWINGS

Further features and advantages of the invention will be more apparent from the detailed description of a preferred, non-exclusive embodiment of a liquid diffusing device with interchangeable nozzles of the invention, which is described as a non-limiting example with the help of the annexed drawings, in which.

DETAILED DESCRIPTION OF A PREFERRED EMBODIMENT

Figure 1:
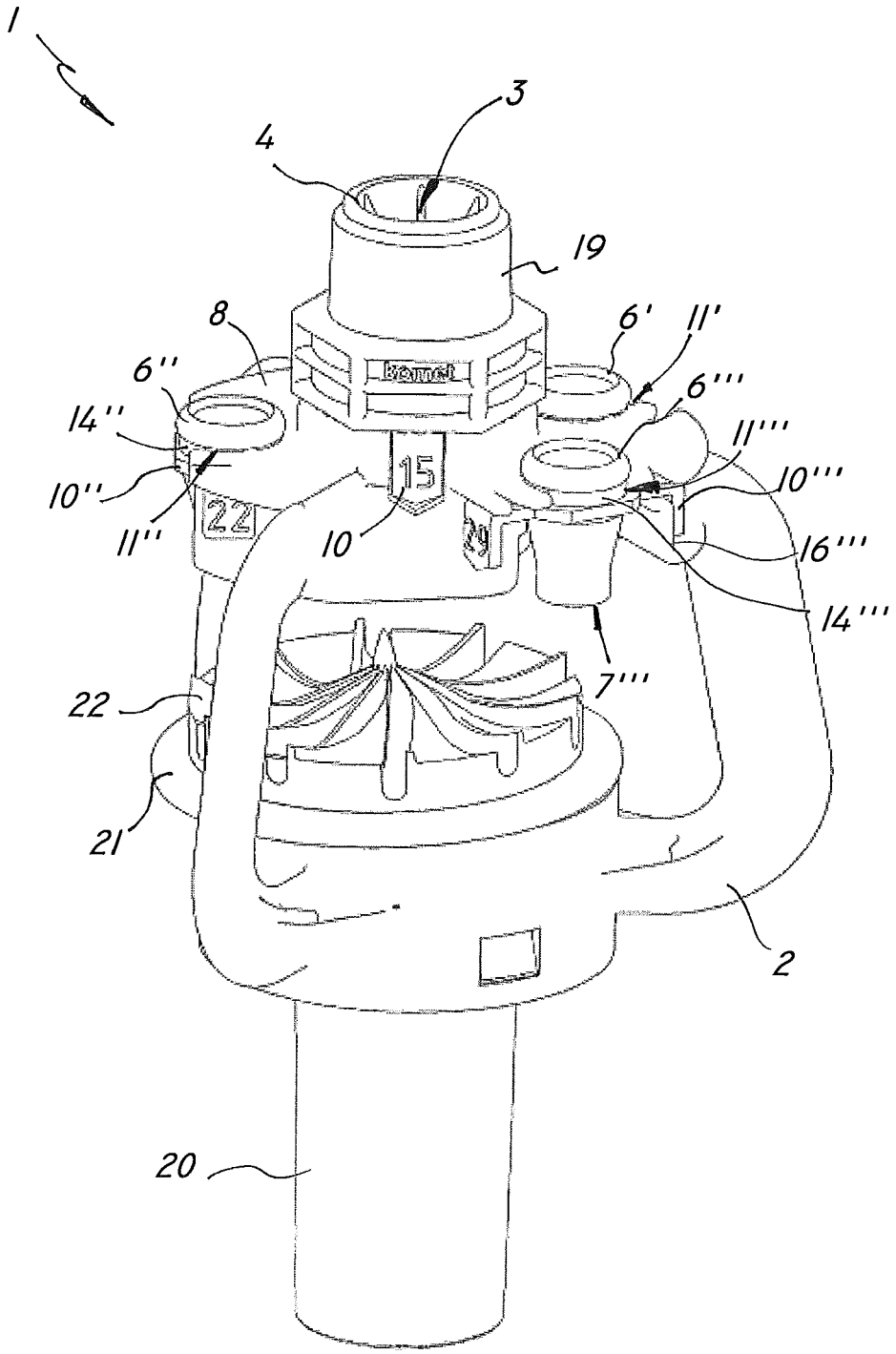
FIG. 1 is a perspective view of a liquid diffuser device of the invention.
Figure 2:
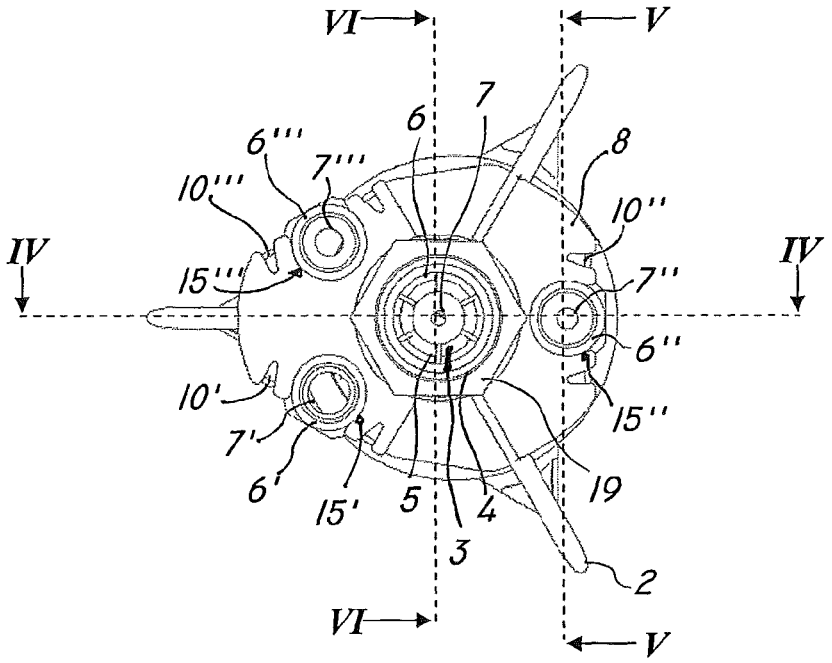
FIG. 2 is a top view of the device of FIG. 1.
Figure 3:
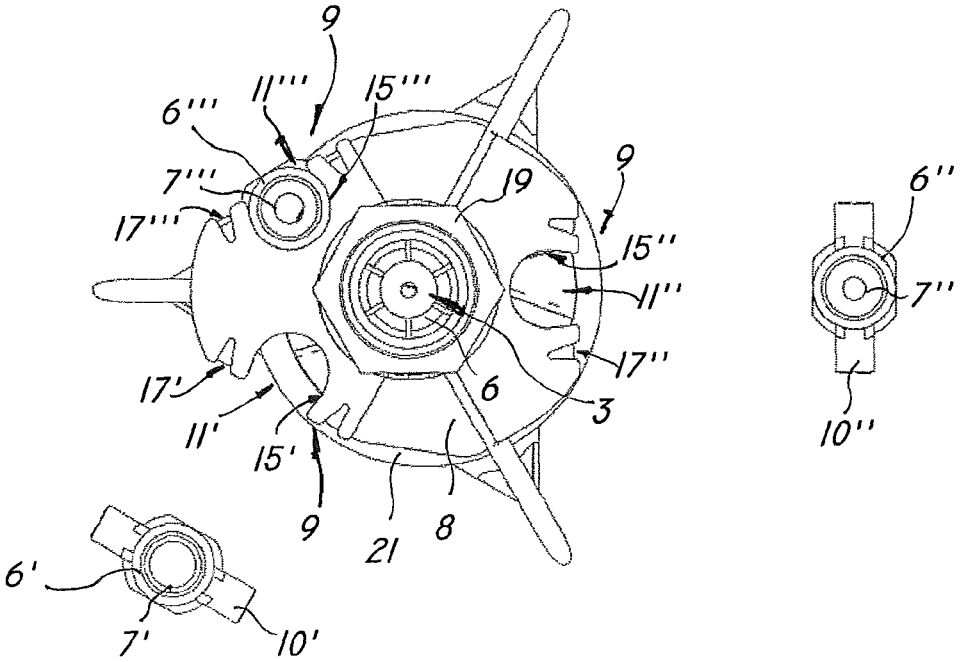
FIG. 3 is an exploded top view of the device of FIG. 1.
Figure 4:
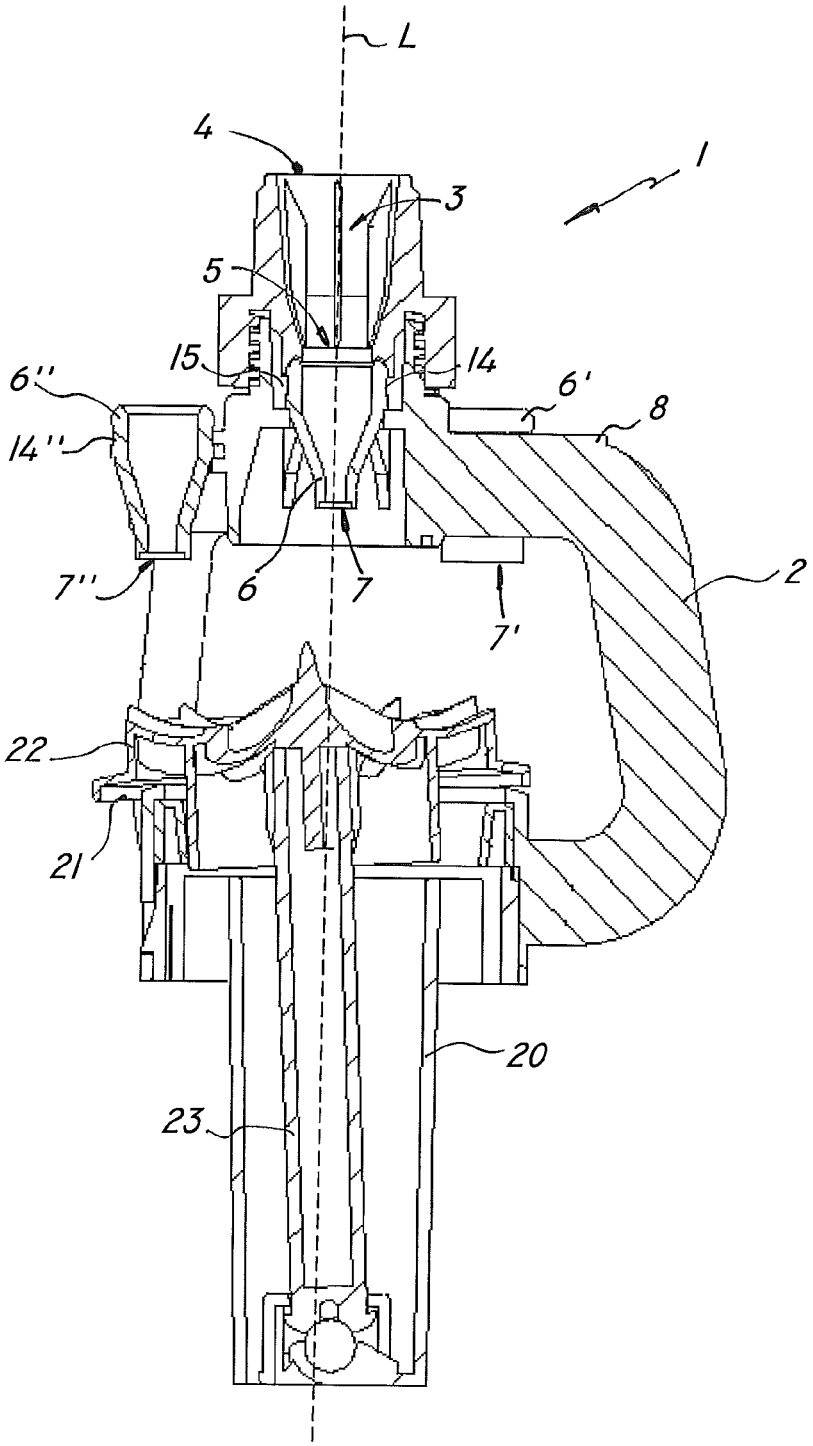
FIG. 4 is a first cross sectional view of the device of FIG. 1.

Referring to the above figures, the device of the invention, generally designated by numeral 1, may be used to distribute a liquid, e.g. water, over surfaces, possibly having a very large surface area, such as in the irrigation of agricultural areas.

The device may be connected to a hydraulic system, not shown, for liquid delivery and may be mounted, alone or in combination with other similar devices, to a stationary or rotating support arm, also not shown, to be set at a predetermined height, according to the desired jet length.

According to the invention, a liquid diffusing device with interchangeable nozzles comprises a support frame 2 having a passageway 3 for the liquid to be diffused, with an inlet 4 and an outlet 5, the inlet 4 being designed to be coupled to a liquid feeding pipe, not shown, and at least one nozzle 6, having a liquid outlet section 7 with predetermined diameter and outflow rate.

The nozzle 6 is removably and selectively attachable to the outlet 5 in a predetermined operating position.

Means are further provided for supporting at least one additional nozzle 6' having an outlet section 7' with a diameter other than that of the nozzle 6 selectively placed in the operating position and adapted to direct a liquid jet with a corresponding outflow rate.

According to a peculiar characteristic of the present invention, the support means comprise a nozzle-holding plate 8 formed of one piece with the frame 2 and having quick connect/disconnect means 9 for the nozzles 6, 6', for holding at least one of the nozzles 6, 6' against the frame 2 in the non-operating position.

The device as shown in the accompanying figures has four nozzles, i.e. an operating nozzle, designated with numeral 6 and held in a substantially central operating position, and three more replacement nozzles, designated with numerals 6', 6", 6'".

The nozzles 6, 6', 6", 6'" may have respective outlet sections 7, 7', 7", 7'" having corresponding diameters, all or part of which have different diameters.

Nevertheless, it shall be understood that the number of nozzles 6, 6', 6", 6'" to be mounted to the plate 8 may be even considerably different from that of the figures, the only limit being given by the size of the plate 8 and the nozzles 6, 6', 6", 6'" in use from time to time.

The nozzles 6, 6', 6", 6'" may be designed with known arrangements, with outlet sections 7, 7', 7", 7'" that, in the operating position, may be coaxial with the passageway 3 or offset therefrom to define an outlet direction inclined to the axis L defined by the passageway 3.

The nozzles 6, 6', 6", 6'" may be also equipped with an identification plate 10, 10', 10", 10'" bearing a number that indicates the diameter of the corresponding outlet section 7, 7', 7", 7'".

In a preferred non-limiting embodiment of the invention, the quick connect/disconnect means 9 may include a plurality of holding seats, three in the illustrated configuration, which are designated by numerals 11', 11", 11'".

Unless otherwise stated, reference will be made herein to the nozzles 6, 6', 6", 6'" and the holding seats 11', 11", 11'", and associated components by designating them by non-indexed reference numerals.

Nevertheless, it shall be understood that all the characteristics related to elements designated by non-indexed reference numerals will be found in a substantially similar manner in element designated by indexed reference numerals.

The holding seats 11 may be formed with shapes substantially mating those of the intermediate sections for attachment of the nozzles 6 and may have, for instance, substantially circular, elliptical, polygonal or the like shapes.

Also, the seats 11 will define respective non-operating positions for removably accommodating the replacement nozzles 6.

The holding seats 11 may be substantially similar, to accommodate any one of the replacement nozzles 6', 6", 6'", as well as the operating nozzle 6, after removal thereof from the operating position, for high convenience of use.

The holding seats 11 may be peripherally closed for snap fit of the nozzles 6 from the top or the bottom.

However, the holding seats 11 may be preferably formed at the periphery of the plate 8 and have respective curved lateral peripheral openings to facilitate sliding insertion and extraction of the nozzles 6 in corresponding directions.

The sliding motion of the nozzles 5 for insertion or extraction thereof into and out of the plate 8 may occur in any direction, e.g. a substantially radial direction.

In order to facilitate stable coupling of the nozzles 6 and the plate 8, the former may have a specially shaped peripheral groove 14 at their inlet sections for snap fitting with the peripheral counter-shaped edge 15 of any one of the holding seats 11.

Figure 5:
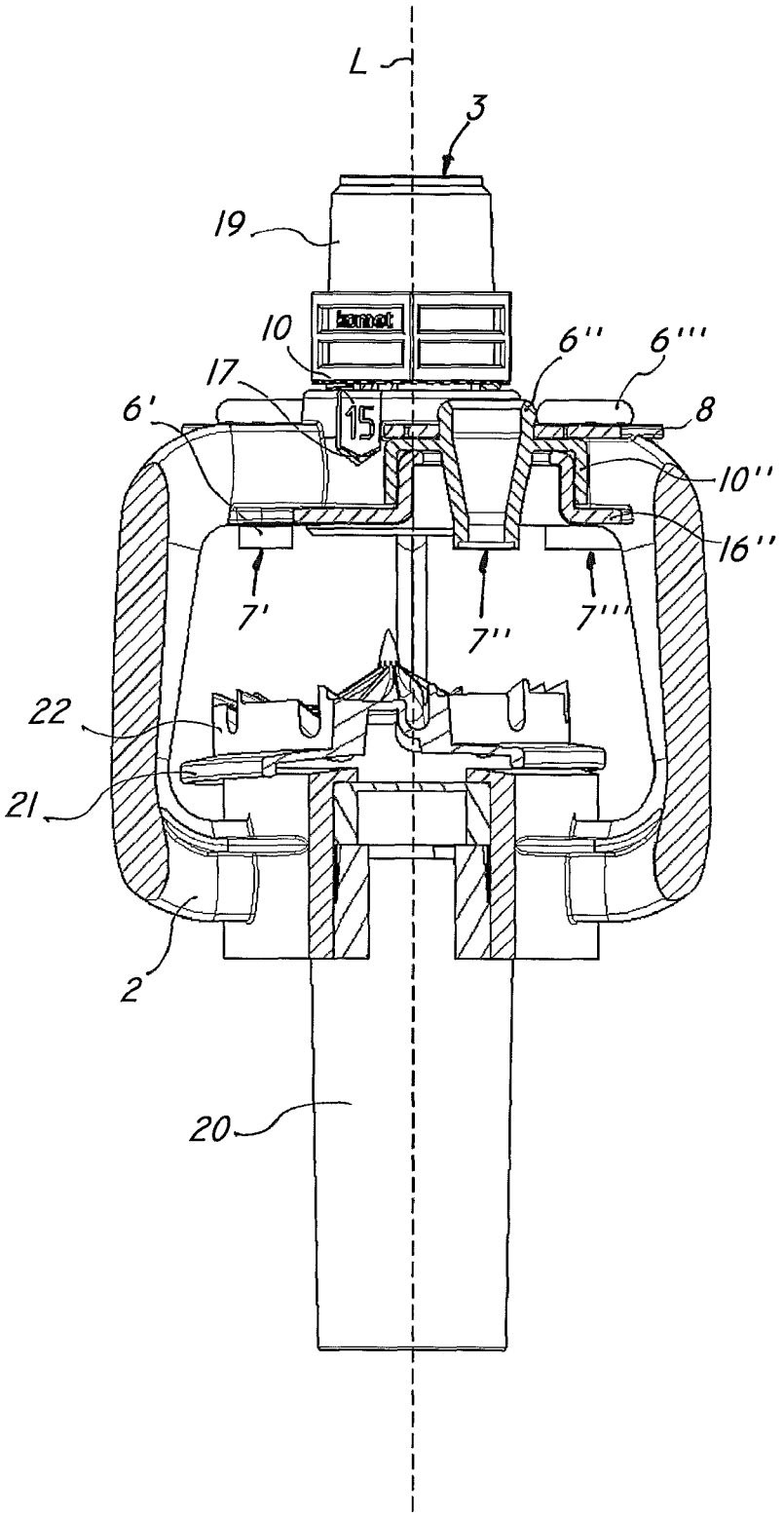
FIG. 5 is a second cross sectional view of the device of FIG. 1.
Figure 6:
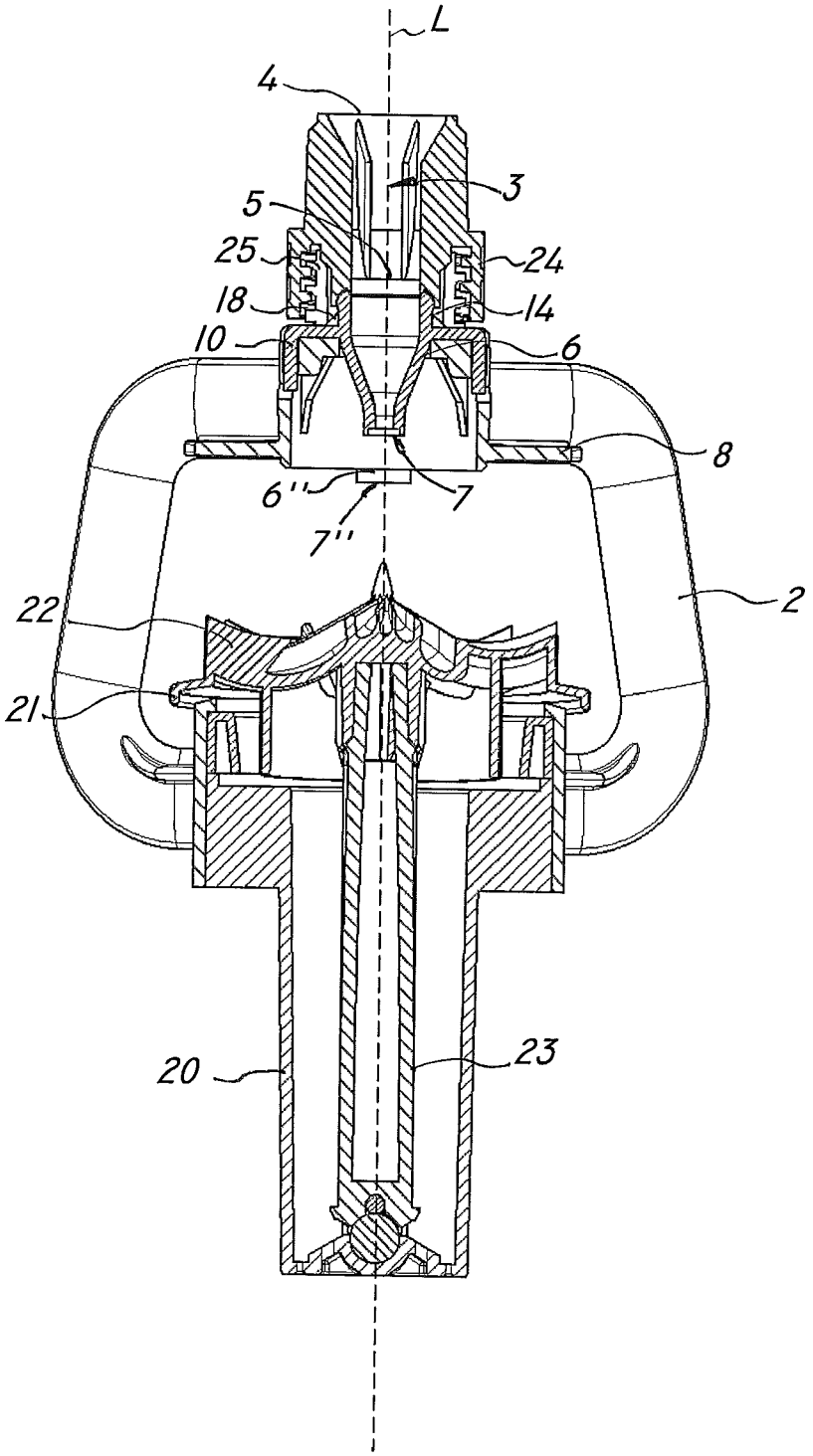
FIG. 6 is a third cross sectional view of the device of FIG. 1.

As more clearly shown in FIG. 5, each of the holding seats 11 may have a lower portion 16 adapted to receive and hold the identification plates 10 of the nozzles 6.

Advantageously, the lower portions 16 of the seats 11 may have lateral openings 17 to allow the plates 10 to be read at any angle and allow simple and quick identification of the nozzles 6 by a user.

Conveniently, the frame 2 may have an annular projection 18 downstream from the outlet 5 of the passageway 3, which is designed for snap engagement of the peripheral groove 14 of the nozzle 6 selectively moved to the operating position.

Thus, the nozzles 6 will be mounted to the plate 8 by connect/disconnect means 9 similar to those that are used to mount the operating-position nozzle 6, without requiring any other fixation systems.

The frame 2 may be composed of a hollow tubular portion 19 defining the passageway 3 for the liquid and a main hollow body 20 associated with the hollow tubular portion 19 and housing a fixed or rotating deflecting member 21 for peripheral jet deflection.

Conveniently, the nozzle-holding plate 8 may be fixed to the frame 2 or be integral therewith, e.g. formed of one piece or in a single mold, and disposed at the passageway 3, i.e. at the periphery thereof and coaxially therewith, monolithic with the tubular portion 19 of the frame 2.

The deflecting member 21 may include, as is known, an upper diffusion plate 22, which may be fixedly housed on the main body 20 of the frame 2, or be of rotating type, like in the embodiment of the figures.

Here, the plate 22 may be integral with a lower stem 23 and face towards the operating-position nozzle 6.

Nevertheless, the deflecting member may be provided in other configurations, and be constructed in accordance with any arrangement known to the skilled person, without any limitation to the present invention.

Furthermore, the hollow tubular portion 19 may be situated either above the main body 20, to direct a liquid jet from top to bottom, and below it, to direct the jet from bottom to top.

The main body 20 and the hollow tubular portion 19 may have respective removable mutual coupling surfaces 24, 25, such as a nut and screw assembly, to allow removal of the tubular portion 19 from the main body 20 and snap-fit assembly of one of the nozzles 6 into the operating position by an axial sliding motion.

The tubular portion 19 may have one or more pairs of lateral openings 26 to better expose the identification plate 10 of the nozzle 6 selectively moved into the operating position.

The above disclosure clearly shows that the invention fulfills the intended objects and particularly meets the requirement of providing a liquid diffusing device with interchangeable nozzles that affords quick and simple nozzle replacement.

With the particular configuration of the device, the nozzle-holding plate will be constantly coupled to the device, and the nozzles will be effectively mounted to the plate even after a relatively large number of extractions and insertions of the former from and into the latter.

The device of this invention is susceptible to a number of changes and variants, within the inventive concept disclosed in the appended claims. All the details thereof may be replaced by other technically equivalent parts, and the materials may vary depending on different needs, without departure from the scope of the invention.

While the device has been described with particular reference to the accompanying figures, the numerals referred to in the disclosure and claims are only used for the sake of a better intelligibility of the invention and shall not be intended to limit the claimed scope in any manner.

What is claimed is:

1. A liquid diffusing device with interchangeable nozzles, comprising:

a support frame having a passageway configured to diffuse a liquid, said passageway having an inlet and an outlet defining a longitudinal axis, said inlet being arranged for coupling to a liquid feeding pipe;

at least one nozzle removably and selectively attachable to said outlet in an operative position and having an inlet section and an outlet section of predetermined diameters such to provide a corresponding flow rate; and means for supporting in an inoperative position at least one additional nozzle with an outlet section having a differentiated diameter with respect to the at least one nozzle;

wherein said support means comprise a nozzle-carrying plate monolithic with said support frame and provided with quick connect/disconnect means to connect said at least one additional nozzle in the inoperative position to said nozzle-carrying-plate;

wherein said quick connect/disconnect means comprise a plurality of appropriately shaped holding seats each providing a support position for said at least one additional nozzle in the inoperative position;

wherein said holding seats are provided along a peripheral portion of said nozzle-carrying plate and have side peripheral openings to allow an insertion of said at least one nozzle and said at least one additional nozzle by sliding along respective predetermined directions, each of said side peripheral openings being curved to receive and enable extraction of said inlet section of said additional nozzle from a respective side peripheral opening along a substantially radial direction relative to said longitudinal axis;

wherein each of said at least one nozzle and said at least one additional nozzle has a peripheral slot on said outer wall of said inlet section, said slot being designed to snap couple and uncouple along said substantially radial direction with a counter-shaped peripheral edge of anyone of said holding seats;

wherein said frame has a hollow tubular portion defining said passageway and a main body coupled to said hollow tubular portion to house a deflecting member for a peripheral diffusion of the liquid;

wherein said deflecting member includes an upper plate provided with at least one radially extending deflection channel, each of said additional nozzles being radially offset relative to said upper plate; and wherein said holding seats are configured to allow a mounting of each of said at least one additional nozzle with the outlet section thereof oriented toward said deflecting member to optimize replacement efficiency.

2. The liquid diffusing device with interchangeable nozzles as claimed in claim 1, wherein said holding seats are shaped to firmly support anyone of said at least one nozzle and said at least one additional nozzle.

3. The liquid diffusing device with interchangeable nozzles as claimed in claim 1, wherein said nozzles have respective tag plates for identifying the diameter of the outlet section, and wherein each of the holding seats has a housing portion for one identification tag plate laterally open to allow an immediate identification of the corresponding nozzle.

4. The liquid diffusing device with interchangeable nozzles as claimed in claim 1, wherein said support frame has, downstream of said outlet of said passageway, an annular projection shaped to snap engage with said peripheral slot of one of nozzles selectively located in said operative position.

5. The liquid diffusing device with interchangeable nozzles as claimed in claim 1, wherein said nozzle-carrying plate is a substantially annular member formed proximate to said passageway peripherally and coaxially thereto.

6. The liquid diffusing device with interchangeable nozzles as claimed in claim 1, wherein said main body and said hollow tubular portion have respective removable coupling surfaces to allow said tubular portion to be removed from said main body and one of said nozzles to be axially slid and snap engaged into said operative position.

* * * * *